US005910769A

United States Patent [19]

Geisler

[11] Patent Number: 5,910,769

[45] Date of Patent: Jun. 8, 1999

[54] SHOPPING CART SCANNING SYSTEM

[76] Inventor: Edwin Geisler, c/o Yorktown Electronic Associates, 238 Rocklawn La., Lancaster, Pa. 07601

[21] Appl. No.: 09/086,062

[22] Filed: May 27, 1998

[51] Int. Cl.[6] ..... G08B 13/14

[52] U.S. Cl. ..... 340/568.5; 186/62; 250/222.1

[58] Field of Search ..... 340/568.5; 186/62; 250/222.1; 194/905

[56] References Cited

U.S. PATENT DOCUMENTS

| | | | |
|---|---|---|---|
| 3,725,894 | 4/1973 | Geisler | 340/568 |
| 4,338,594 | 7/1982 | Holm | 340/568 |
| 5,485,006 | 1/1996 | Allen et al. | 340/568 |
| 5,500,526 | 3/1996 | Shalvi et al. | 340/568 |
| 5,610,584 | 3/1997 | Schrade | 340/568 |

*Primary Examiner*—Nina Tong
*Attorney, Agent, or Firm*—Zachary T. Wobensmith, III

[57] ABSTRACT

A shopping cart scanning system is disclosed comprised of first and second photoelectric devices situated in a check-out counter and respectively located at the entrance and exit portion of a scanning field. The photoelectric devices both operate in a retro-reflective mode and operatively cooperate with a reflective strip that is attached to the shopping cart. The photoelectric device, and their associated circuits, are arranged to detect the presence or absence of packages in the lower tray of the shopping cart as the shopping cart moves through a check-out counter.

10 Claims, 8 Drawing Sheets

SHOPPING CART SCANNING SYSTEM

BACKGROUND OF THE INVENTION

1. Field of the Invention

The present invention relates to scanning articles in a shopping cart and, more particularly, to a scanning system situated at a check-out counter for scanning for the presence of articles in the lower basket of a shopping cart and providing a voice message upon the detection thereof.

2. Description of the Prior Art

Shopping carts are commonly used in self-service stores to gather articles that are brought to a check-out counter where the articles are itemized and reckoned up to the total cost so as to allow the customer to provide payment for the outgoing merchandise.

During the gathering some of the articles may be placed into the lower basket of the shopping cart, and when the shopping cart arrives at the check-out counter sometimes these lower basket articles go undetected because the customer has not removed them from the lower basket, and because of the poor viewing position of the check-out counter clerk relative to the lower basket. This non-detection may become a business loss to the self-service store, an unpaid benefit for the customer, or an additional burden to both the check-out clerk and the customer if the detection of these lower tray articles is realized before the shopping cart leaves the premises of the self-service store and the customer needs to recycle the shopping cart through the check-out counter. It is desired that automatic means be provided that does not rely on the memory of a customer nor the viewing of a check-out clerk to detect for any articles in the lower tray of a shopping cart so that the proper itemizing and total cost may be received for the outgoing merchandise being conveyed off the store premises by the customer.

OBJECTS OF THE INVENTION

It is a primary object of the present invention to provide for a scanning system to detect for articles in the lower tray of a shopping cart.

It is another object of the present invention to provide for a shopping cart scanning system situated into a check-out counter of a store that detects for articles in the lower tray of a shopping cart and reminds, via a voice message, the customer and the check-out clerk that such articles exist therein.

It is a further object of the present invention to provide for a scanning system having means so that the voice message delivered by the scanning system may be altered to meet the needs of the store in which the scanning system is used.

SUMMARY OF THE INVENTION

The present invention is directed to a scanning system for detecting articles in the lower tray of a shopping cart and for providing a voice message upon the detection thereof.

The scanning system monitors the lower tray of a shopping cart mounted at a first predetermined elevation of a shopping cart having a first reflective member affixed thereat a second predetermined elevation. The system detects the presence of articles in the lower tray and comprises first and second photoelectric devices. The photoelectric devices are each responsive to abrupt changes in light intensity and respectively generate first and second output signals. The photoelectric devices are preferably canted at a slight angle (e.g., 5 degrees) so as to respond only to the retro-reflective members associated with the present invention. Regular incident reflections have no effect on the photoelectric devices. The first and second photoelectric devices are separated from each other by a first predetermined distance so as to establish a scanning field, with the first photoelectric device being located at the entrance portion of the scanning field and at an elevation that is in correspondence with the second predetermined elevation so as to define a first light path. The second photoelectric device is located at the exit portion of the scanning field and at an elevation that is in correspondence with the first predetermined elevation so as to define a second light path. The first light path is established when the reflective member is brought into coincidence with the first photoelectric device causing the first output signal to be generated. The second light path, generated by the second photoelectric device, is maintained by a second reflective member until an item of merchandise on the lower tray of the cart interrupts that second light path; in which case a second output signal, preferably in the form of pulse, is generated. The scanning system further comprises means responsive to the first output signal to generate a time interval signal having a first predetermined duration and means responsive to the second output signal for generating a voice message if the second output signal is generated before the first predetermined duration expires.

BRIEF DESCRIPTION OF THE DRAWINGS

These and other objects, features and advantages of the present invention, as well as the invention itself, will become better understood by reference to the following detailed description when considered in conjunction with the accompanying drawings, wherein like reference numbers designate identical or corresponding parts throughout and wherein:

FIG. 8 is composed of FIGS. 8(A) and 8(B), wherein

DETAILED DESCRIPTION OF THE PREFERRED EMBODIMENTS

Figure 1:
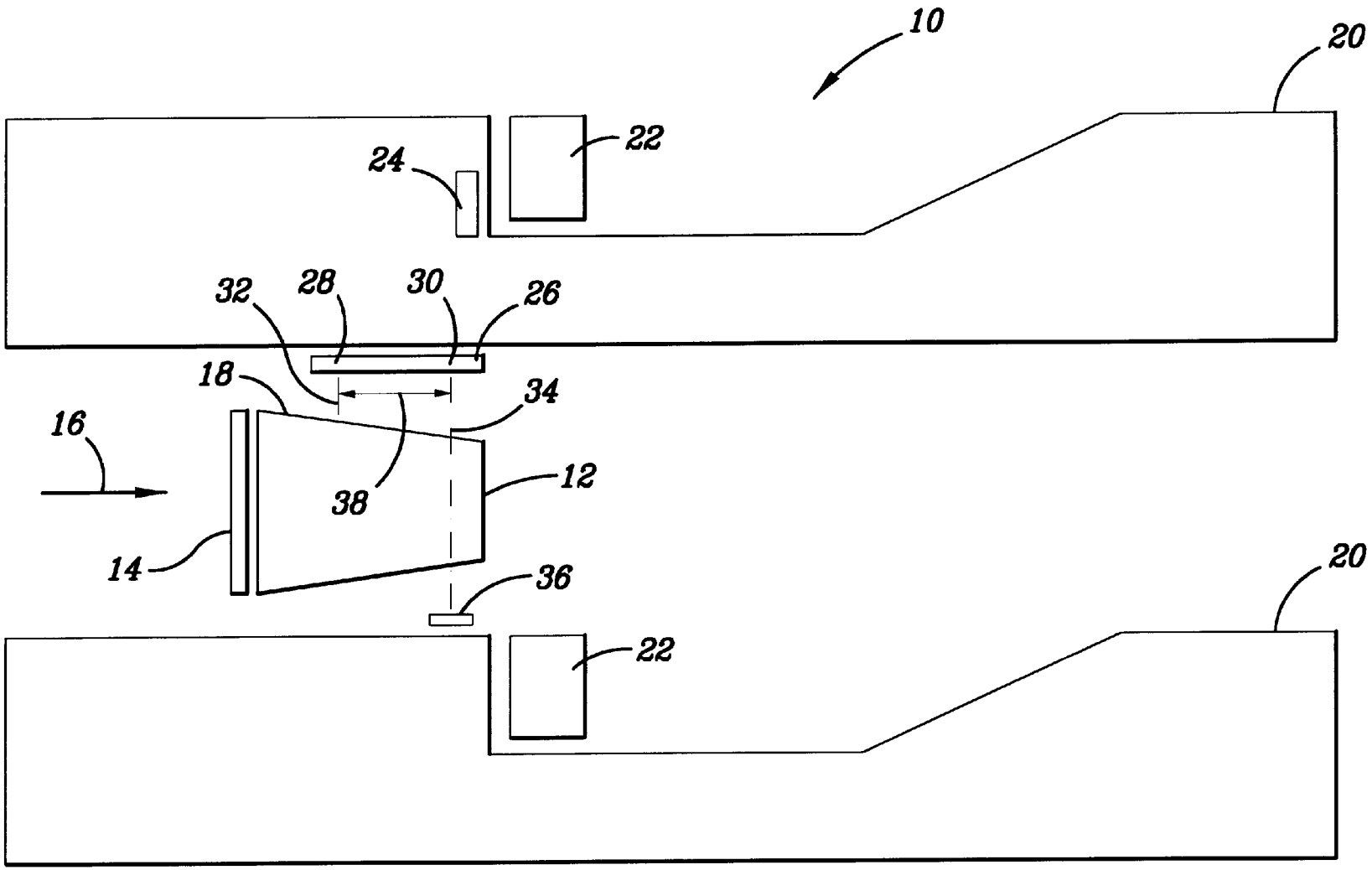
FIG. 1 is a top view of the check-out counter primarily illustrating the placement of essential elements of the present invention.

Referring to the drawings, FIG. 1 illustrates a system 10 for monitoring a lower tray of a shopping cart 12 having a handle 14, capable of being moved in a direction indicated by arrow 16, and having a reflective member 18. The reflective member 18 is preferably a reflective tape and, more particularly, is a retro-reflective tape known in the art. The shopping cart 12 is well known and found in self-service stores. The shopping cart 12 has a lower basket mounted on the shopping cart at a first predetermined elevation, and at least one upright support member to which is affixed the reflective member 18 at a second predetermined elevation. FIG. 1 illustrates a top view of the shopping cart 12 being moved in a normal manner with the front portion of the shopping cart 12 entering and being moved between the alley separating two adjacent check-out counters 20.

Each of the check-out counters 20 has an associated check-out register 22 operated by a check-out clerk (not shown) and control electronics 24 that operatively cooperates with an optical system 26. The optical system 26 comprises first and second photoelectric devices 28 and 30 which respectively have first and second light paths 32 and 34, wherein the second light path 34 is established, in part, by a reflective element 36.

The first and second photoelectric devices 28 and 30 are separated from each other by a first predetermined distance having a typical value of between 10 inches and 12 inches so as to establish a scanning field 38. The photoelectric devices 28 and 30 operate in the retro-reflective mode, known in the art, that causes the devices to reflect radiation (as light) so that the path of reflected rays are parallel to those of the incident rays. The photoelectric devices 28 and 30 are preferably canted at a slight angle (e.g., 5 degrees) so as to respond only to the retro-reflective members 18 and 36 associated with the present invention. Regular incident reflections have no effect on the photoelectric devices 28 and 30. The photoelectric devices 28 and 30 produce respective output signals upon sensing an abrupt or rapid change in the light intensity contained in the reflected rays.

The first photoelectric device 28 is located at the entrance portion of the scanning field 38 and the second photoelectric device 30 is located at the exit portion of the scanning field 38. The first and second photoelectric devices 28 and 30 are each established at a predetermined elevation relative to the lower basket of the shopping cart 12 and reflective member 18, respectively, which may be further described with reference to FIG. 2 which is a front view of a check-out counter 20 having a bumper 40.

Figure 2:
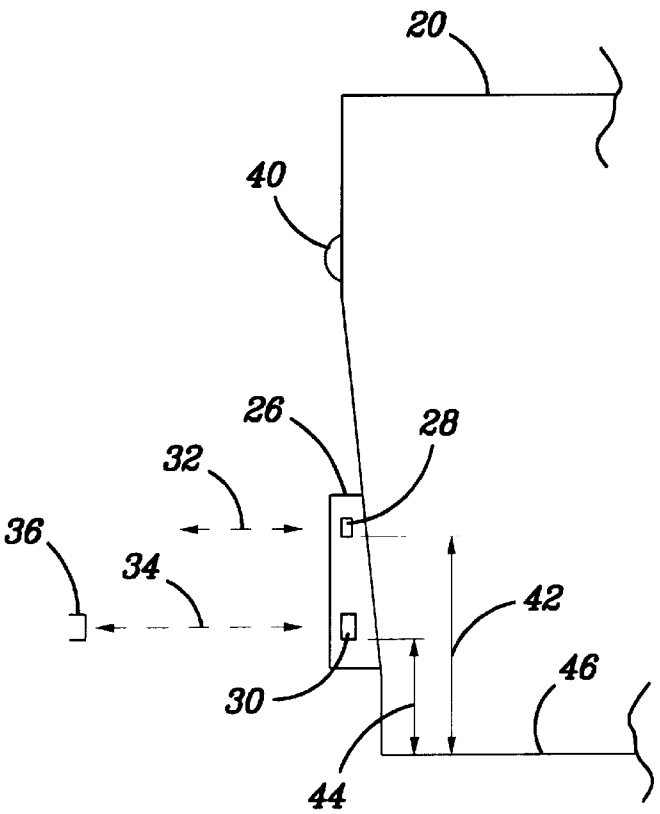
FIG. 2 is a front view of the arrangement of FIG. 1 illustrating the placement of the photoelectric devices of the present invention.

As seen in FIG. 2, the first photoelectric device 28 is positioned so as to be located at an elevation 42 which corresponds to the elevation of the reflective member 18 that is preferably placed on an upright support member that connects the lower tray of the shopping cart 12 to the remainder of the shopping cart 12. More importantly, the location 42 establishes the first light path 32 when the reflective member 18 is brought into coincidence, by the movement of the shopping cart 12 in a manner as to be further described with reference to FIG. 8(A), with the first photoelectric device 28 causing the first photoelectric device 28 to generate a first output signal 50 to be further described with reference to FIG. 8B. The second light path 34, generated by the second photoelectric device 30, is maintained by a second reflective member 36 until an item of merchandise on the lower tray of the cart 12 interrupts that second light path 34, in which case a second output signal, preferably in the form of pulse, is generated. As will be further described with reference to FIG. 8(B), when the lower tray has articles therein, the articles interrupt the second light path 34, thereby, generating the second output signal 52. Each of the elevations 42 and 44 are relative to the floor 46 on which the check-out counter 20 is resting, and on which the shopping cart 12 moves. The arrangement of the photoelectric devices 28 and 30 may be further described with reference to FIG. 3 which is a side view of the check-out counter 20 and wherein the entrance into the alley between the two checkout counters 20 of FIG. 1 is illustrated by directional arrow 48.

Figure 3:
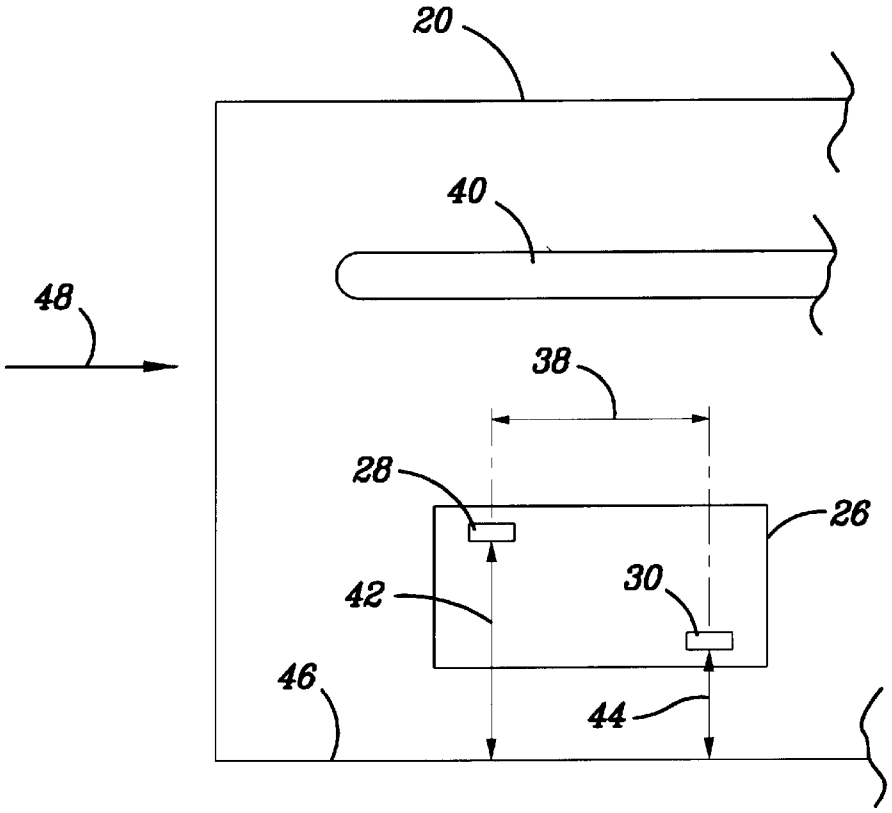
FIG. 3 is a side view of the arrangement of FIG. 1 further illustrating the placement of the photoelectric devices of the present invention.

As seen in FIG. 3, the first and second photoelectric devices 28 and 30 having their respective predetermined elevations 42 and 44 are spaced apart from each other so as to establish the scanning field 38 also shown in FIG. 1. The photoelectric devices 28 and 30 upon the establishment of their light paths 32 and 34, respectively, and operatively cooperating with the control electronics 24 generate first and second control signals 50 and 52, interchangeably referred to herein as trigger signal 50 and pulse 52, respectively, which may be further described with reference to FIGS. 4–7 accumulatively illustrating control electronics 24 comprised of a plurality of elements having typical values/types and general descriptions (if applicable) as given in Table 1; wherein all resistors are ⅛ W carbon film types unless otherwise indicated.

TABLE 1

| REFERENCE NUMBER/ CHARACTER | TYPICAL VALUE/TYPE | GENERAL DESCRIPTION (IF APPLICABLE) |
|---|---|---|
| R1,R11,R12 | 100K | |
| R2,R7 | 47K | |
| R3 | 15K | |
| R4 | 20K | TRIM POT-SINGLE TURN, BOURNS#3352T |
| R5, (R15 - Fixed) | 470K | R5 TRIM POT-SINGLE TURN, BOURNS#3357T |
| R6,R8 | 24K | |
| R9,R10,R13,R16 | 10K | |
| R17 | 5.1K | |
| R18,R19 | 56K | |
| R20 | 10K | VOLUME CNT.ON/OFF SW |
| R21 | 10 ohms | |
| C1 | 600 MF @ 35 V | |
| C2,C3,C4 | 10 MF @ 25 V | |
| C15,C16,C18,C19 | 0.1 MF | |
| C8,C9,C10,C13,C11 | 0.1 MF | |
| C4 | 10 MF @ 16 V | |
| C5 | 47 MF @ 16 V | |
| C6,C7,C21 | 0.05 MF | |
| C12 | 4.7 MF @ 16 V | |
| C14,C20 | 220 MF @ 16 V | |
| C17 | 0.001 MF | |
| U1 | 78L12ACLP | TO-92 12 v. Reg. |
| U2 | 78L05ACLP | TO-226 5 v. Reg. |
| U3 | LM556C | Dual Timer |
| U4 | ISD1416P | Information Storage Devices |
| U5 | LM386 | Audio amp. |
| CR1,CR2 | 1N914 | Diodes |
| CR3 | WL005F | 50 v PIV 1 AMP. BRIDGE-FAGOR or equiv. |
| Q1,Q2 | 2N3904 | Switching Transistor |
| M1 | | Mouser#25LM040 - Electret mike |
| S1 | #85502 | Speaker - 8 ohms |
| F1 | #252.250 | Littlefuse 0.28 × 0.95" |

Figure 4:
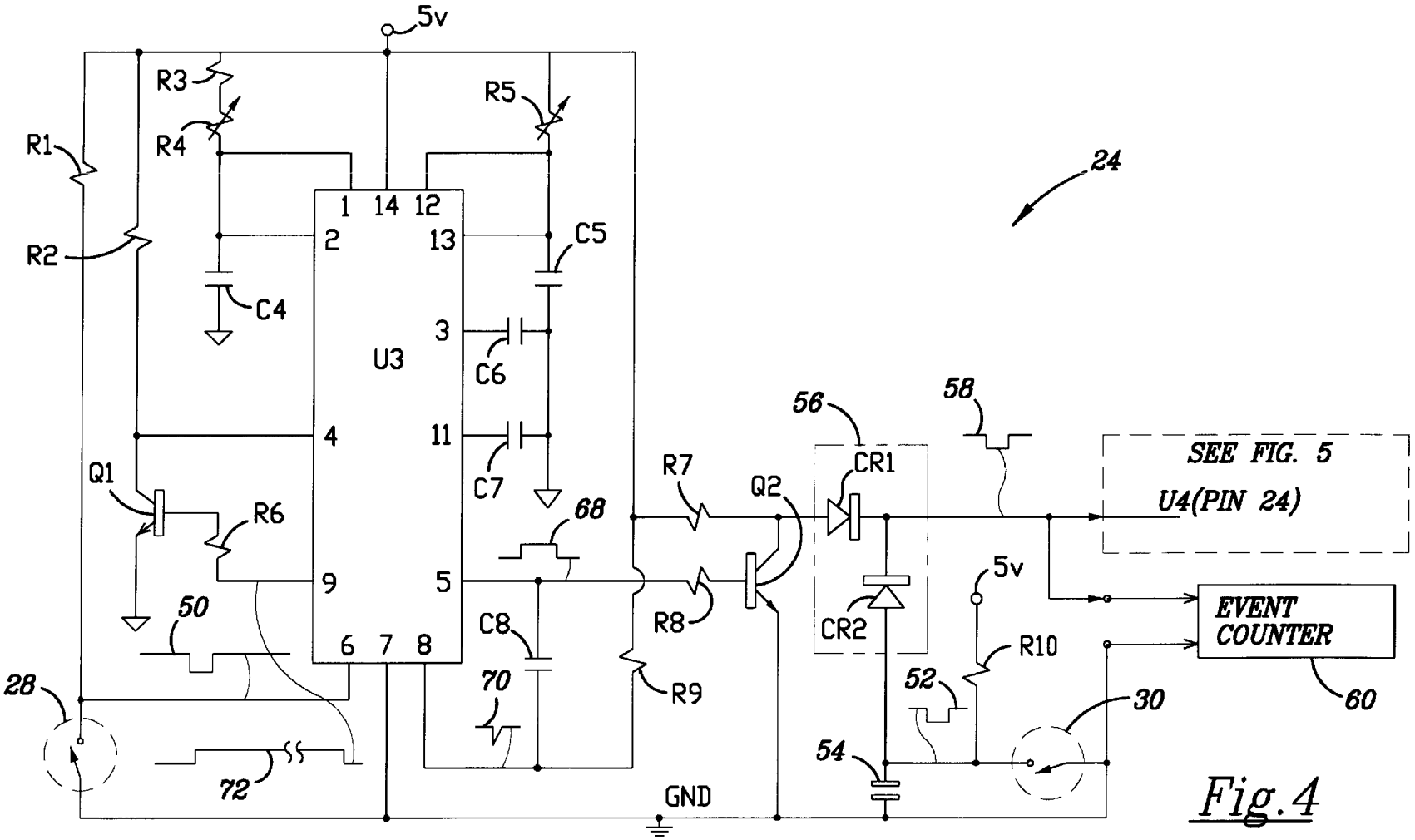
FIGS. 4, 5, 6 and 7 are schematics of the control electronics associated with the shopping cart scanning system of FIG. 1.

In general, the control electronics 24 of FIGS. 4–7 serve as the means responsive to the trigger signal 50, shown in FIG. 4, to generate a time interval signal having a predetermined duration between 200 and 250 ms. The means (comprising U3 of FIG. 4) responsive to the trigger signal 50 sets a one-shot T1 for 0.25 seconds. Further, the control electronics 24 of FIGS. 4–7 serve as means responsive to the second pulse 52 for generating a voice message if the second control signal 52, shown in FIG. 4, is generated before the predetermined duration of between 200 to 250 ms expires. The control electronics 24 cooperate with the photoelectric devices 28 and 30 which may detect objects in the lower tray of the shopping cart 12 and remind the customer and the check-out clerk that such an article is detected by means of a voice message or flashing/beeping sound asking the customer/check-out clerk to check the bottom of the shopping cart.

As seen in FIG. 4, the pulse 52 generated by the photoelectric device 30 is applied to AND circuit 56 formed from two diodes CR1 and CR2 arranged as shown. The AND circuit 56, upon being qualified, generates a signal 58 which is routed to a conventional events counter 60 that records the number of occurrences of the presence and absence of the output 58 of the AND circuit 56 during a first predetermined duration of between 200 and 250 ms. The output 58 of AND circuit 56 is applied to pin 24 of the U4 device shown in FIG. 5.

In general, U4 is a "voice recording chip" that stores, in one embodiment, up to 16 seconds of a voice message in 128K of EPROM. The voice output of U4 is made available at pins 14 and 15 thereof respectively connected to capacitors C15 and C16. The outputs of the capacitors C15 and C16 are applied, via resistors R18 and R19, to pins 2 and 3 of the U5 device of FIG. 6. The U5 device, is typically a one (1) watt amplifier used to boost the volume of its received signal and generates an output signal 64 which represents the voice message telling the customer and check-out clerk to check for articles in the lower basket of the shopping cart 12. The U5 device as well as other devices of the control electronics 24 of FIGS. 4–6 utilize the power supply illustrated in FIG. 7.

Figure 7:
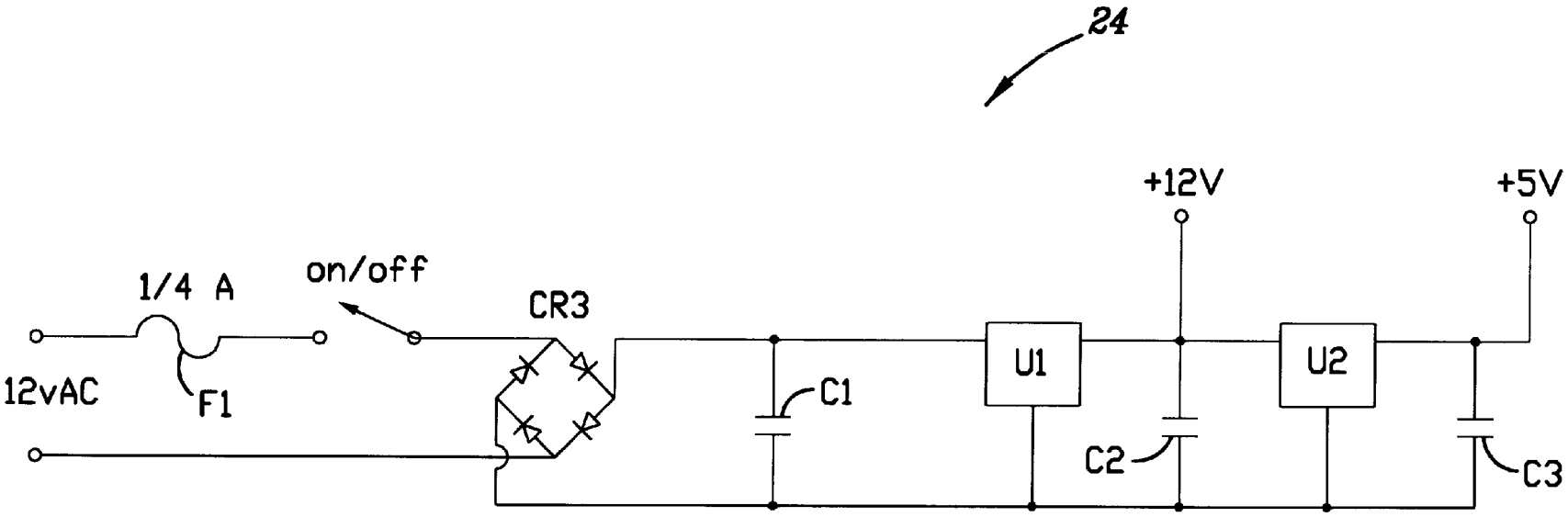

The power supply of FIG. 7 has an input stage comprising a full-wave rectifier CR3 that receives, via fuse F1 and an on-off switch, an input a.c. voltage of 12 v. A.C. and develops a D.C. output that is delivered to the serial arrangement comprising a 12 volt regulator U1 and a 5 volt regulator U2.

The overall operation of the control electronics 24 cooperating with the photoelectric devices 28 and 30 may be further described with reference to FIG. 8 which is composed of FIGS. 8(A) and 8(B) respectively illustrating the photoelectric initiation for detecting articles in the lower tray of the shopping cart 12 and the actual detection of articles in the lower tray of the shopping cart 12.

Figure 8B:
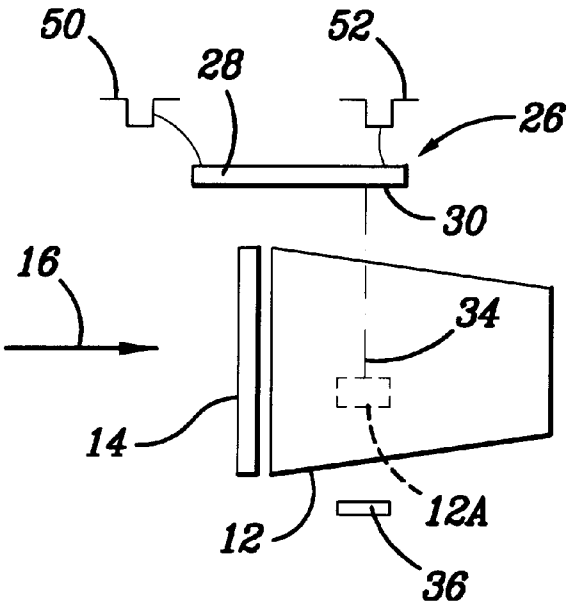
FIG. 8(B) illustrates the shopping cart exiting the scanning field of the present invention.
Figure 8A:
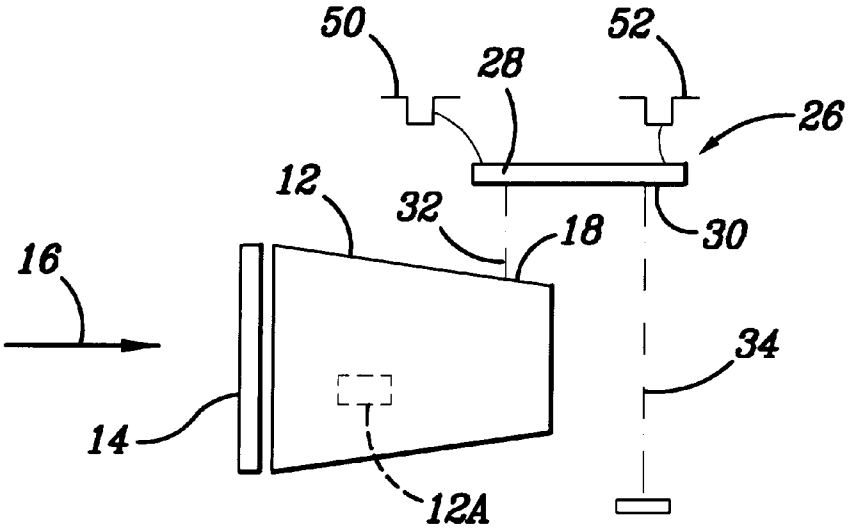
FIG. 8(A) illustrates the shopping cart entering into the scanning field of the present invention.

FIG. 8(A) illustrates a shopping cart 12 having a package 12A (shown in phantom) located in the lower tray thereof. The shopping cart 12 is moved by handle 14 in direction 16 so that when the reflective element 18 preferably located on the upright structure member of the shopping cart 12 comes into coincidence with the photoelectric device 28 the first control signal 50 of the control electronics 24 is generated. The coincidence between the photoelectric device 28 and the reflective member 18 establishes the first light path 32. At this time the second light path 34 is already established by the presence of the reflective member 36.

Figures 9, 9A, 9B, 9C, 9D, 9E, 9F:
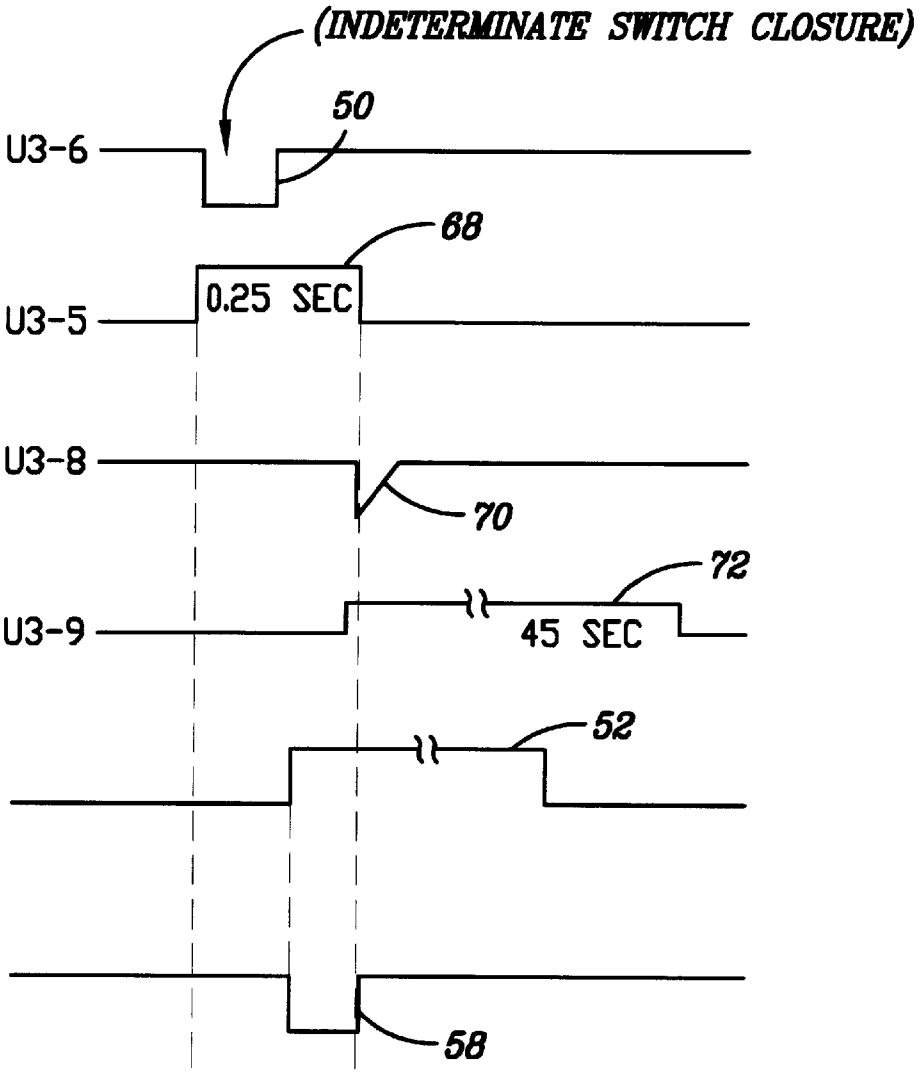
FIG. 9 is composed of FIGS. 9(A), 9(B), 9(C), 9(D), 9(E), and 9(F) that illustrate the operational sequence associated with the scanning system of the present invention.

FIG. 8(B) illustrates the shopping cart 12 as having been moved, relative to its position of FIG. 8(A), so that the package 12A in the lower tray of the shopping cart 12 comes into coincidence with the second photoelectric device 30 so that the second control signal 52 is generated by the control electronics 24. The operation of the control electronics 24 may be further described with reference to FIG. 9 which is composed of FIGS. 9(A), 9(B), 9(C), 9(D), 9(E) and 9(F) respectively illustrating the signals 50, 68, 70 and 72, 52 and 58. The signals 68 and 72 of FIG. 9 have respective typical durations of about 0.25 seconds and about 45 seconds, whereas signal 50 has a duration typically less than that of signal 68 and which is determined by switch closure of the photoelectric device 30. The signals 50, 68, 70, 72, 52 and 58 are also all shown in FIG. 4.

As seen in FIG. 4, the first trigger signal 50 is applied to pin 6 of the U3 device serving as both a timer 1 and as a timer 2. The signal 68 appears at the output of U3 on pin 5 thereof, the signal 70 appears at the trigger input of T2 at U3 pin 8, and the signal 72 appears at the output of U3 at pin 9 thereof.

In operation, and with simultaneous reference to FIGS. 4, 6, 8 and 9, when the shopping cart 12, in particular the reflective tape 18 on the shopping cart 12 is placed into coincidence with the photoelectric device 28, the signal 50 is generated which, in turn, causes the timer T1 within the device U3 to be triggered. This timer T1 is predetermined and adjusted by R4 for a set period, that is, for signal 68 to establish the set condition of timer T1 of U3 of between 100 milliseconds to 350 milliseconds. The timer T1 within the device U3 generates the signal 70 with the negative going edge thereof setting a timer T2, also within U3, via pin 8, resistor R9, adjustable resistor R5, capacitor C5 and pin 12 of U3. The timer T2 is set so as to have a first predetermined duration by adjusting R5 so as to achieve a duration of between 30 to 90 seconds (previously mentioned). This duration serves as the set condition of timer T2 and causes the timer T2, internal to U3, to generate the signal 72 on pin 9 of U3 which qualifies Q1 so as to keep pin 4 of U3 low for the duration (30 to 90 seconds). The system 10, in particular of the timers T1 and T2 of U3, is then inhibited from being triggered by the re-occurrence of the first control signal 50, for the duration of the T2 set time.

Since the output of timer T1, that is, signal 68 and the output of the photoelectric device 30, that is, signal 52, are added by AND circuit 56, in particular the arrangement of diodes CR1 and CR2, the timer T1 determines the length of time that the photoelectric device 30 views the bottom of the shopping cart 12 as it moves through the scanning field 38 so that, in this example, the article 12A may be detected.

Figure 5:
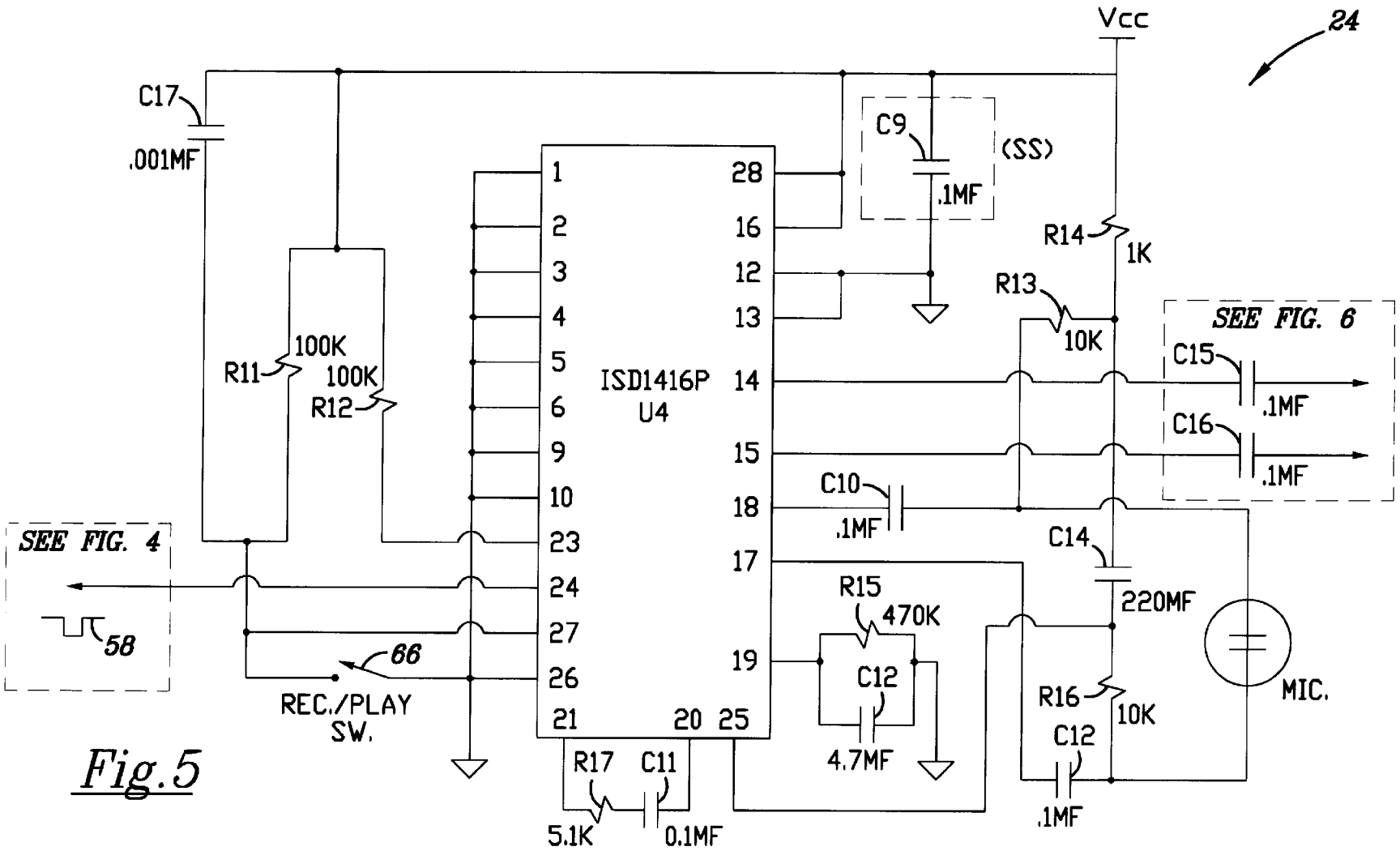
Figure 6:
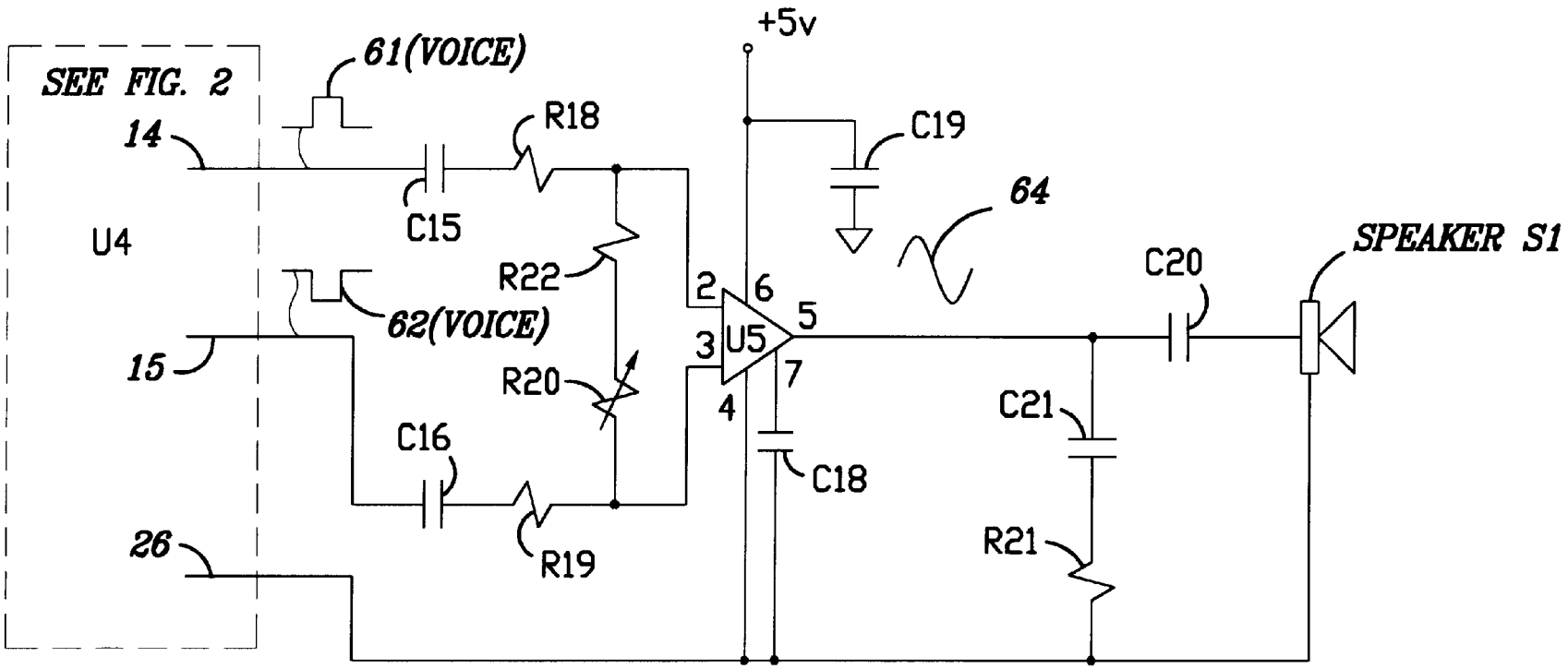

The detection of article 12A, in turn, causes the generation of signal 52 which, in turn, qualifies AND gate 56 which, in turn, generates the signal 58 that is applied, to the pin 24 of U4 of FIG. 5. The device U4, serving as a voice chip, is triggered by the falling edge of signal 58. The device U4 supplies its voice signal to pins 14 and 15 that are routed to the booster amplifier U5. The device U5 generates signal 64, that is applied to the speaker (S1) which, in turn, causes the voice message to ask the customer to check the bottom of their cart.

It should be recognized that if the photoelectric device 30 does not sense any articles in the lower tray of the shopping cart 12 within the first predetermined duration of between about 200 ms to 250 ms initiated by the first control signal 50, then a second control signal 52 will not be generated and the first predetermined duration will expire and the control electronics 24 will wait for the first control signal 50 generated by the photoelectric device 28 to re-occur.

It should now be appreciated that the practice of the present invention provides for a scanning system that automatically detects for the presence of packages on the lower tray of the shopping cart and reminds the customer and the check-out clerk of this detection by way of a voice message asking the customer to check the bottom of their shopping cart. Alternately, in a manner known in the art, the voice message mechanism of the present invention may be replaced with an arrangement of a flashing LED and beeper mounted on the cash register 20 of FIG. 1, essentially asking the customer and/or check-out clerk to check the bottom of their shopping cart.

The scanning system of the present invention further provides means for recording new messages and which may be further described with reference to FIG. 5.

As seen in FIG. 5, the message may be recorded by placing a record/play switch 66 into its closed position so that pin 27 of U4 is placed in its low condition. Once the switch 66 is so closed, the message may be recorded by speaking into the microphone and having its information supplied via pins 17, 18 to U4.

It should now be further appreciated that the practice of the present invention not only provides for a scanning system that detects for packages in the lower tray of the shopping cart, but also allows for the capability for the voice messages to be entered into the control electronics 24 so as to serve the need of the store in which the scanning system 10 of the present invention serves. Further, as previously discussed with reference to FIG. 4, the events recorder 60 records the number of signals 58 generated by AND circuit 50 which in actuality is recording the number of packages detected in the lower tray of the shopping cart.

It is understood that the invention is not limited to the specific embodiments herein illustrated and described but may be otherwise without departing from the spirit and scope of the invention.

What I claim is:

1. A system for monitoring a lower tray mounted at a first predetermined elevation on a shopping cart having a reflective member at a second predetermined elevation, said system detecting the presence of articles in said lower tray, said system comprising:

(a) first and second photoelectric devices each responsive to abrupt changes in light intensity and generating first and second output signals respectively, said first and second photoelectric devices being separated from each other by a first predetermined distance so as to establish a scanning field, with said first photoelectric device being located at the entrance portion of said scanning field and at an elevation that is in correspondence with said second predetermined elevation so as to define a first light path, and with said second photoelectric device being located at the exit portion of said scanning field and at an elevation that is in correspondence with said first predetermined elevation so as to define a second light path, said first light path being established when said reflective member is in coincidence with said first photoelectric device causing said first output signal to be generated, said second light path being interrupted when any article that is present in said lower tray is in coincidence with said second photoelectric device causing said second output signal to be generated;

(b) means responsive to said first output signal to generate a time interval signal having a first predetermined duration; and (c) means responsive to said second output signal for generating a voice message if said second output signal is generated before said first predetermined duration expires.

2. The system according to claim 1, wherein said lower tray is connected to said shopping cart by at least a vertical upright member and said reflective member is a retro-reflective tape affixed to said vertical upright member.

3. The system according to claim 2, wherein said retro-reflective tape has dimensions of about one (1) inch in width and about four (4) inches in length.

4. The system according to claim 1, wherein said first predetermined duration is within a range from about 200 ms to 250 ms.

5. The system according to claim 1 further comprising means for inhibiting the response to said first output signal if said first output signal reappears within a second predetermined duration from its previous occurrence.

6. The system according to claim 5, wherein said second predetermined duration is about 45 seconds.

7. The system according to claim 1, wherein said means for generating a voice message comprises an AND circuit having first and second inputs respectively comprising said means to generate said time interval signal and said second output signal, said AND circuit having an output applied to a voice message generator.

8. The system according to claim 7 further comprising an event recorder that records to the number of occurrences of the presence and absence of the output of said AND circuit during said predetermined duration.

9. The system according to claim 1, wherein said first predetermined distance is in the range from about 10 inches to about 12 inches.

10. The system according to claim 1, wherein said means for generating a voice message further comprises means for recording a voice message which serves as said voice message.

* * * * *